United States Patent [19]

Owens

[11] 4,336,079

[45] Jun. 22, 1982

[54] STABILIZATION OF CARBON IN AUSTENITIC ALLOY TUBING

[75] Inventor: Clark McG. Owens, Colchester, Conn.

[73] Assignee: Combustion Engineering, Inc., Windsor, Conn.

[21] Appl. No.: 82,508

[22] Filed: Oct. 9, 1979

[51] Int. Cl.[3] ..... C22F 1/10

[52] U.S. Cl. ..... 148/11.5 N; 148/12.7 N; 148/162

[58] Field of Search ..... 148/2, 11.5 N, 12 R, 148/12 E, 38, 136, 12.3, 143, 142, 12.7 N, 32.5, 162

[56] References Cited

U.S. PATENT DOCUMENTS

| | | | |
|---|---|---|---|
| 2,246,445 | 6/1941 | Kiefer | 148/136 |
| 3,082,132 | 3/1963 | Melill | 148/136 |
| 3,347,715 | 10/1967 | Pfeil | 148/38 |
| 3,437,477 | 4/1969 | McCune | 148/12.3 |
| 3,623,920 | 11/1971 | Kondo et al. | 148/142 |
| 3,669,759 | 6/1972 | Kondo et al. | 148/136 |
| 3,723,193 | 3/1973 | Reimann et al. | 148/12.3 |
| 3,740,274 | 6/1973 | Chow | 148/12 E |
| 4,168,994 | 9/1979 | Owens | 148/12 E |

FOREIGN PATENT DOCUMENTS

| | | | |
|---|---|---|---|
| 49-16698 | 4/1974 | Japan | 148/12 E |
| 1124287 | 8/1968 | United Kingdom | 148/12 E |

*Primary Examiner*—Peter K. Skiff
*Attorney, Agent, or Firm*—L. James Ristas

[57] ABSTRACT

A heat treating process for homogenizing high nickel alloy material so that the carbon is stabilized in the form of carbides having chromium-sufficient "envelopes". A heavily coldworked intermediate sized tube is annealed by a continuous conveyor furnace for about 20 minutes at a temperature of about 1350° F. The stabilized product is then cold worked to final size and annealed at a temperature about 1485° F., without the occurrence of sensitization and the associated susceptibility to corrosion attack. The final product has extremely fine grain size and the carbides are distributed throughout the grains. The method is also suitable for use on other austenitic alloys.

4 Claims, 1 Drawing Figure

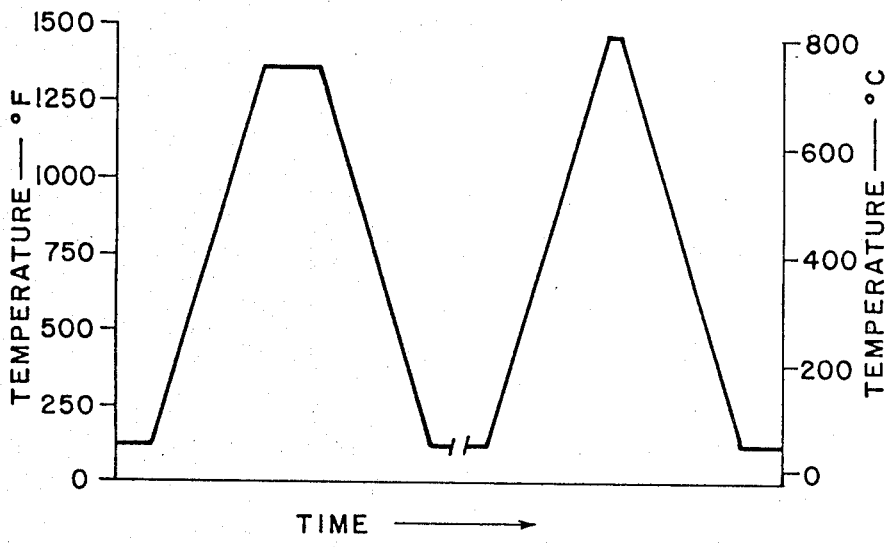
1500
1250
1000
750
500
250
0
TEMPERATURE — °F
800
600
400
200
0
TEMPERATURE — °C
TIME

STABILIZATION OF CARBON IN AUSTENITIC ALLOY TUBING

BACKGROUND OF THE INVENTION

This invention relates to a heat treating process for the stabilization of carbon in austenitic alloy material whereby the carbon is stabilized in the form of carbides having chromium-sufficient "envelopes".

High nickel alloys such as Inconnel 600 are particularly useful in tubing for nuclear steam generators, where their good heat transfer and corrosion-resistant properties are desired. The high nickel alloys are typically composed of 99 percent nickel-chromiumiron, and less than 0.05 percent carbon. If such tubes are not stabilized they can be susceptible to corrosion attack during use. This is due to a condition known as sensitization, which occurs at temperatures between 800° and 1400° F. (425° and 760° C.).

Sensitization is a microstructural condition wherein chromium carbide particles are formed in the grain boundaries to produce a network of chromium-deficient "envelopes" around each carbide. Envelope chromium content is not high enough to resist acid attack so the tube is susceptible to intergranular corrosion.

The prior art practice for stabilizing tubing to be used in a steam generator can be summarized as follows. The steam generator fabricator receives finally sized tubes from the tube mill that have been desensitized by the solution anneal method. These tubes have been desensitized by annealing at temperatures high enough to dissolve all chromium carbides. Carbon is thus put in solid solution as an interstitial element, and kept there by rapid cooling. Solution annealed tubing has therefore been desensitized but not stabilized. Subsequent heating into the sensitization temperature range during steam generator fabrication or tube stress relieving will again produce sensitization and susceptibility to corrosion, if the tubes are not stabilized. The prior art method of stabilizing the carbon is to heat the solution annealed tubing for 15 to 21 hours at about 1300° F. (700° C.), long enough for all the carbon to be tied up in the form of chromium-sufficient carbides. The prolonged heating first causes sensitization, i.e., the carbon comes out of solution to form carbides in the grain boundaries. During the latter portion of the prolonged heating, chromium diffuses slowly into the carbide envelopes and thus the tube becomes desensitized and homogenized with all carbon tied up as carbon tied up as carbides in the grain boundaries.

Although stabilization is achieved with the prior art techniques, it would be desirable to stabilize tubes while they are in the intermediate size (about 25 feet or 7.5 m) so that conventional furnaces can be used, and to reduce the heat treatment time so that a continuous stabilization in conveyor furnace can be ahieved.

SUMMARY OF THE INVENTION

The present invention achieves both these improvements, thereby offering significant cost savings by eliminating the capital outlay for construction of oversized furnaces, and reducing the time and energy costs per unit of stabilized tubing. The homogenization is performed early in the manufacturing process, before the tubing has attained its final length. Homogenization can thus be incorporated as a routine step in the normal manufacturing process.

According to the invention, a heavily cold-worked intermediate product is isothermally heated in the upper carbide precipitation temperature range for at least 15 minutes. Typically, satisfactory homogenization occurs within about 20 minutes and preferably in about 30 minutes. For homogenization to occur in such a short time is quite surprising. It appears to be due to the heavy cold working, which preconditions the microstructure so that upon heating, all the carbon atoms diffuse quickly into the grain boundaries to form chromium carbides. Almost simultaneously sufficient excess chromium also migrates into the boundaries, so that the chromium carbide is surrounded by sufficient chromium very soon after the carbide is formed.

After homogenization, all carbon is in the grain boundaries in the form of carbides having chromium-sufficient surfaces. Subsequent cold working to final size does not produce dissolved carbon. Thus, the homogenized tubing can be safely reheated into and above the sensitization range (below dissolution temperature) in order to obtain other desired annealed properties in the final product. The carbides remain stabilized. This final anneal recrystallizes the material but no new carbides are formed, since all carbon was "locked up" as carbides during the homogenization.

In the preferred embodiment the tube reduction to final size by cold-working and the final anneal at 1485° F. (810° C.), performed after the stabilization step, produce an extremely fine grained microstructure having the carbides distributed throughout the grain. The extremely fine gain and the dispersion of the carbide gives the tubes a much higher strength than the prior art products.

Thus, the present invention is directed to a process for stabilizing carbon in austenitic alloy tubing, and a high nickel alloy tube having extremely fine grained microstructure with the dispersion hardening effect of the carbides in the grain but not in the grain boundaries.

BRIEF DESCRIPTION OF THE DRAWING

Other objects and the particular process of the invention will become more apparent from the specification and the accompanying drawing in which the single FIGURE is a temperature-time diagram that graphically shows the process of the invention.

DESCRIPTION OF THE PREFERRED EMBODIMENT

With the present invention, homogenization is effected to accomplish carbon stabilization and chromium diffusion early in the tube making process before material from which the tubing is being made is reduced to its final length where it is long and inconvenient to handle. Furthermore, homogenization can be effected in a continuous conveyor furnace.

According to the present embodiment of the invention, Inconel 600 typically is obtained in the form of an extruded tube hollow. The extrusion is tube-reduced and solution-annealed. Typically, three or four additional cold-working steps are required to generate a tube having a final outside diameter in the range of $\frac{3}{4}$ to $\frac{7}{8}$ inch (1.9 to 2.2 cm).

The stabilization of carbon in the tubing is accomplished at no extra cost by annealing the heavily cold-workeds final intermediate size ($1\frac{1}{8}$ inch or 3.2 cm O.D.) at a temperature 1350° F. (720° C.) for 20 to 30 minutes. This can be accomplished in a continuous annealing furnace and provides for all carbon to precipitate and for the chromium to heal the attendent depleted zoness. After stabilization the tube is cold-worked to final size and annealed at 1485° F. (810° C.) to recrystallize, but not to disturb the previously formed carbide particles. The Figure graphically illustrates the relationship between time and temperature represented by the preferred embodiment of the invention.

The microstructure resulting from the homogenization and final annealing consists of a network of carbide-free grain boundaries superimposed over an array of carbide particles previously formed and strung out in lines by the final reduction process. These carbides do not have a chromium depleted envelope and heating into the sensitization range will not alter the microstructured. The carbon is tied up and as generally defined, this material is immune to sensitization.

It is noted that in the preferred embodiment the precipitation and healing step of the final intermediate size tubing and the final anneal, which optimizes the properties of the finally sized tubing to meet the ultimate user's specifications, are performed in a hydrogen environment conveyor furnace.

It should be appreciated that the present invention provides several advantages over the prior art:

1. Carbon stabilization can be achieved in a conveyor furnace on tubes of any length.

2. Carbon stabilization is achieved in only about 20 minutes by isothermally annealing a heavily cold-worked tube at between 1300° F. and 1500° F. Although this stabilization is preferably made on the final intermediate sized tube, it can be made on other intermediate tube sizes if the tube resulted from heavy cold working.

3. A tube that is stabilized according to the invention, even if not subsequently annealed, exhibits satisfactory corrosion resistance relative to solution-annealed (or mill-annealed) tubing. Solution-annealed tubing has excellent corrosions resistant properties so long as it has not been sensitized by heating into the sensitization range after the solution annealing.

4. In the preferred embodiment of the invention, the stabilized tubing is then cold-worked (as by tube reduction to final size) and annealed at 1485° F. (810° C.) to produce a stabilized final product that is much stronger than solution-annealed tubing, while retaining comparable resistance to corrosion.

5. The following table compares selected properties of the novel process stabilized (PS) tubing with solution annealed (SA) tubing of the type used to fabricate nuclear steam generators. The comparison is made for two different carbon contents in the alloy Inconel 600. The data on the PS tube are preliminary and should be viewed as substantially representative of a product made according to the inventive process including the tube drawing and annealing subsequent to the isothermal stabilization.

| Carbon Content (%) | 0.02 | | 0.04 | |
|---|---|---|---|---|
| Tube Treatment | PS | SA | PS | SA |
| Corrosion Resistance | | | | |
| Percent weight loss, modified Huey test (25% boiling $HNO_3$ 48 hrs.) | 0.06 | 0.055 | 0.08 | 0.075 |
| Percent weight loss in sulfurous acid (7.4%, 24 hrs. at room temp.) | 0.007 | 0.0020 | 0.005 | 0.0045 |
| Mechanical Properties | | | | |
| Ultimate strength (ksi) | 114 | 99.5 | 114 | 105.4 |
| Yield strength (ksi) | 60 | 43.0 | 61 | 49.0 |
| Elongation (in % 2 in.) | 33 | 39.2 | 32 | 35.0 |
| Grain Size ASTM No. | 11 | 7.5 | 11 | 9 |

According to the modified Huey test, the stabilized product is as corrosion resistant as the solution annealed product. There is, however, a slight increase in susceptibility to attack by sulfurous acid, but the absolute levels of corrosion are still quite satisfactory.

It can also be seen that the mechanical properties include substantial improvements in the yield strength without significant loss of ductility. Furthermore, the grain size is extremely fine as compared with the solution annealed product. It is believed that the grain size can be reduced even further if, prior to the isothermal stabilization step, the first intermediate size tube is annealed at about 1485° F. to refine the grain size. The smaller grain size is not the only contribution to the greater strength. The average carbide particle size in the inventive tube is about 2000–3000 angstrom, whereas the prior art stabilized tubes have an average carbide particle size of about 8000–10,000 angstrom.

Although the preferred embodiment of the invention has been described, it shouldd be understood that the isothermal sensitization/desensitization steps, during which precipitation and healing occur, may be made in the temperature range of about 1300° F. to about 1500° F. (700° C. to 815° C.) without departing from the invention. The upper temperature limit is that at which carbide precipitation occurs without carbide dissolution. It should be further understood that annealing subsequent to the stabilization steps can be performed at temperatures up to about 1700° F. (925° C.), above which carbide dissolution occurs and the stabilization is destroyed. It appears, however, that the optimum combination of corrosion resistance and mechanical properties occurs when the final anneal temperature is about 1485° F. (810° C.). Furthermore, unlike some prior art techniques, the rate of cooling was found to have little effect on the quality of the stabilization.

The inventive method described herein has been used to produce a corrosion resistant, high strength alloy of Inconel 600. The method is believed to improved corrosion resistance and strength when used on any austenitic alloy that has not been chemically stabilized, as by the addition of columbium or tantalum. For example, Incaloy 800 or any of the 300 series of stainless steels may be satisfactorily treated according to the general inventives method, although the specific temperature range may be slightly different from those preferred for Inconel 600.

I claim:

1. A process for stabilizing carbon in solution-annealed Inconnel tubing having a carbon content in the range of about 0.02–0.05 weight percent, comprising the steps of: heavily cold working the tubing; annealing the cold worked tubing for at least fifteen minutes but less then two hours within a temperature range of 1300°–1500° F., so that essentially all the carbon precipitates in the grain boundaries as stabilized chromium carbide having chromium healed envelopes; whereby the tubing is permanently immune from intergranular corrosion so long as the tube temperature never exceeds the carbide dissolution temperature.

2. The process of claim 1 wherein the carbon stabilization is performed at a temperature of about 1350° F. for between 20 and 30 minutes.

3. The process of claim 1 wherein the carbon stabilization is performed continuously in a conveyor furnace.

4. The process of claims 1 or 2 wherein the carbon content is in the range of 0.02–0.04 weight percent.

* * * * *